US007429935B1

(12) United States Patent
Brenner

(10) Patent No.: US 7,429,935 B1
(45) Date of Patent: Sep. 30, 2008

(54) DIRECTIONAL AUDIO TRAIN SIGNALING SYSTEM AND METHOD

(76) Inventor: Matthew D. Brenner, 331 Hillside Ave., Charlotte, NC (US) 28209

( * ) Notice: Subject to any disclaimer, the term of this patent is extended or adjusted under 35 U.S.C. 154(b) by 123 days.

(21) Appl. No.: 11/165,172

(22) Filed: Jun. 24, 2005

(51) Int. Cl.
*G08G 1/095* (2006.01)

(52) U.S. Cl. ..... 340/907; 246/473.1; 246/292

(58) Field of Classification Search ..... 340/907, 340/709; 246/473.1–473.2, 486, 292, 294
See application file for complete search history.

(56) References Cited

U.S. PATENT DOCUMENTS

| | | | | |
|---|---|---|---|---|
| 3,758,775 | A * | 9/1973 | Hopkins | 246/125 |
| 4,942,395 | A * | 7/1990 | Ferrari et al. | 340/907 |
| 5,429,329 | A * | 7/1995 | Wallace et al. | 246/166 |
| 5,515,026 | A * | 5/1996 | Ewert | 340/436 |
| 6,052,336 | A | 4/2000 | Lowrey, III | |
| 6,267,332 | B1 * | 7/2001 | Almblad | 246/294 |
| 6,457,682 | B2 * | 10/2002 | Anderson et al. | 246/292 |
| 6,471,162 | B1 * | 10/2002 | Pace | 246/294 |
| 6,985,090 | B2 * | 1/2006 | Ebner et al. | 340/907 |
| 2005/0009497 | A1 * | 1/2005 | Derome et al. | 455/351 |

OTHER PUBLICATIONS

Sound Alert Technology PLC, "Reversing Alarms that Cut Noise Pollution", pdf online, retrieved Nov. 17, 2004, Retrieved from the Internet:<URL: http://www.soundalert.com/reversingalarms.htm.

Sound Alert Technology PLC, "Localizer Directional Sound Technology: Behind the Technology", pdf online, retrieved Nov. 17, 2004, Retrieved from the Internet:<URL: http://www.soundalert.com/technology.htm.

Sound Alert Technology PLC, "Research", pdf online, retrieved Nov. 17, 2004, Retrieved from the Internet:<URL: http://www.soundalert.com/research.htm.

Holosonic Research Labs, Audio Spotlight, retrieved Nov. 17, 2004, Retrieved from the Internet:<URL: http://www.holosonics.com.

Holosonic Research Labs, Audio Spotlight, "Customers/Applications", retrieved Nov. 17, 2004, Retrieved from the internet:<URL: http://www.holosonics.com/customers.html.

Holosonic Research Labs, Audio Spotlight, "Technology", retrieved Nov. 17, 2004, Retrieved from the internet:<URL: http://www.holosonics.com/technology.html.

Holosonic Research Labs, Audio Spotlight, "Audio Spotlight Sound Beam Systems Installed in General Motors Display at Walt Disney's Epcot", retrieved Nov. 17, 2004, Retrieved from the Internet:<URL: http://www.holosonics.com/PR_Epcot.html.

(Continued)

*Primary Examiner*—Jeff Hofsass
*Assistant Examiner*—Hongmin Fan
(74) *Attorney, Agent, or Firm*—Hunton & Williams, LLP

(57) ABSTRACT

A system and method for a directional audio train signaling system that comprises a receiver for receiving a signal indicating the approach of a train to a point of interest and one or more directional audio transmitter systems for transmitting a warning related to the approach of a train. A plurality of directional audio transmitters may be used, each with a footprint covering a portion of a roadway approaching an intersection. The receiver may be associated with an acknowledgement transmitter such that a train system confirms receipt of the alarm signal at the receiver.

19 Claims, 5 Drawing Sheets

OTHER PUBLICATIONS

American Technology Corporation, retrieved Nov. 17, 2004, Retrieved from the Internet:<URL: http://www.atcsd.com.

American Technology Corporation, "Technology Licensing-HyperSonic Sound", retrieved Nov. 17, 2004, Retrieved from the Internet:<URL: http://www.atcsd.com/tl_hss.html.

American Technology Corporation, An Overview of American Technology Corporation's Hypersonic™ Sound Technology, "What is HyperSonic Sound Technology?", Part # 98-DSHSS-0001 Rev. E, 2001-2003.

Croft et al., White Paper, Hypersonic Sound, "Theory, History, and the Advancement of Parametric Loudspeakers",A Technology Overview, Rev E., American Technology Corporation, pp. 1-27.

American Technology Corporation, Technology Introduction, "How HSS can Shape the Future of Sound", Part # 98-10006-3000 Rev. F, pp. 1-15, 2001.

American Technology Corporation, Information, HyperSonic Sound, Frequently Asked Questions and Answers, Revision E., pp. 1-13.

House_N Research Template, "House_n Active Noise Control: The MIT Home of the Future", retrieved Nov. 17, 2004, Retrieved from the Internet:<URL: http://architecture.mit.edu/house_n/web/resources/tutorials/House_N%20Tutorial%20Act . . . , pp. 1-6.

American Technology Corporation, Product Information, "HSS Directed Audio Sound System Model Series: 220", Part No. 89-10061-0002, Revision C, 2002-2003.

* cited by examiner

DIRECTIONAL AUDIO TRAIN SIGNALING SYSTEM AND METHOD

FIELD OF THE INVENTION

The present invention relates to the field of train alarm signaling systems.

BACKGROUND OF THE INVENTION

Since the development of the locomotive, people have attempted to develop systems for warning others about a locomotive or train's pending arrival at a particular point. Whistles, flashing lights, and barricades have all been used as strategies to try to prevent humans from being injured from a moving train. Current systems typically employ a combination of these techniques at various points near and around railroad tracks, junctions, and stations.

Perhaps the most prevalent alarm system is a whistle located on the conductor's engine of the train. A train whistle is extremely loud for the purpose of transmitting a signal for very long distances to give humans (such as those in automobiles and other vehicles) advanced warning before the arrival of a train at an intersection. For example, a train signal may be loud enough such that a human in a car with the windows rolled up may still hear the whistle with enough warning such that the train is at a distance of at least half a mile or a mile away. As a consequence of the decibal level of the train signal necessary to warn humans in automobiles and other vehicles, the train signal can often be heard at a great distance in all directions from the train tracks.

Many train tracks exist in areas where houses and other residential developments exist. As a result, humans living in those areas must suffer through extremely loud train signals throughout the day and even late into the night. This loud noise creates a nuisance, causing property values near the train tracks to be lower than those further away from the train tracks and also causing general displeasure with the train system.

These and other drawbacks exist with current systems.

SUMMARY OF THE INVENTION

Accordingly, the various embodiments described herein provide a system and method for a directional audio train signaling system that comprises a receiver for receiving a signal indicating the approach of a train to a point of interest and one or more directional audio transmitter systems for transmitting a warning related to the approach of a train. A plurality of directional audio transmitters may be used, each with a footprint covering a portion of a roadway approaching an intersection. The receiver may be associated with an acknowledgement transmitter such that a train system confirms receipt of the alarm signal at the receiver.

Also, the various embodiments employ a method for signaling a message related to a train through various acts, including, receiving a signal relating to a train and transmitting one or more directional audio signals in an area near a train or train track. A plurality of directional audio signals may be used with overlapping coverage areas to reach portions of a roadway.

According to other embodiments, a system for signaling information related to a train comprises a signal indicator indicating a time to transmit a signal related to a train and one or more directional audio transmitter systems for transmitting a signal relating to a train. A plurality of directional audio transmitters may be provided with a transmission footprint that covers a portion of a roadway approaching an intersection with a train track on which the train is approaching.

Other advantages of the present invention may be appreciated from the foregoing disclosure.

DETAILED DESCRIPTION OF EMBODIMENTS

Figure 1:
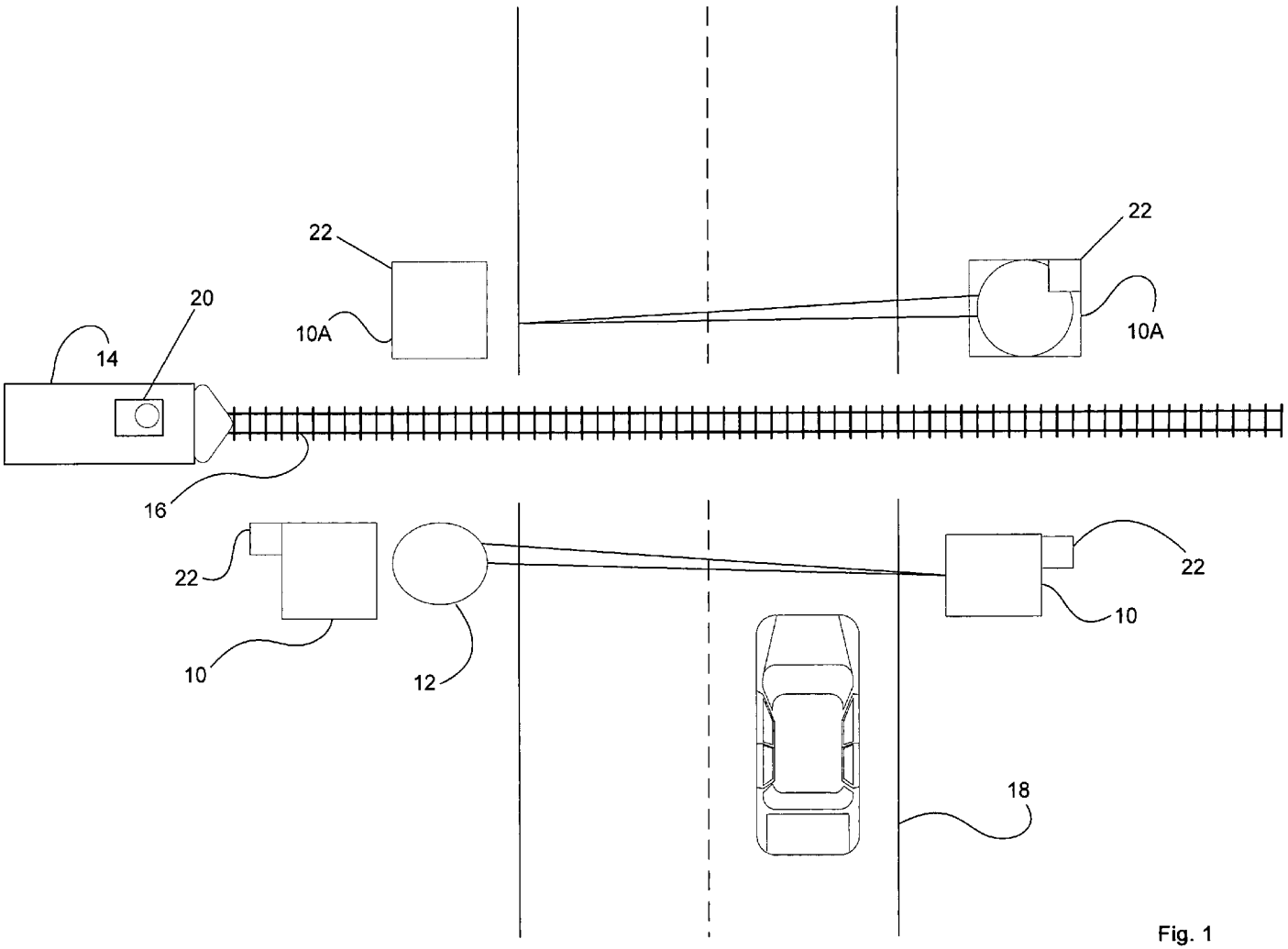
FIG. 1 depicts a schematic layout of a train, train track and intersection with a directional audio signaling system according to an embodiment of the present invention.

Various embodiments of the present invention provide a distinct improvement over train signaling systems and methods utilized in the prior art. In particular, by the use of directional audio transmission systems, the location of the train signals may be directed only where such a warning is desired.

In this application, the phrase directional audio is used to encompass all systems that allow focused transmission of sound or audio. Such systems may be those as described in, for example, U.S. Pat. No. 6,052,336, the entirety of which is hereby incorporated by reference. Other systems encompassed by the phrase "directional audio" may include those currently denominated as audio spotlight, hypersonic sound technology and parametric sound technology. One such embodiment involves an ultrasonic beam containing embedded audio signals as described in the HSS Technical White Paper: Theory, History and the Advancement of Parametric Loudspeakers, the entirety of which is incorporated by reference. All of these systems and other technologies developed for focused, directional transmission of sound and audio are intended to be within the scope of the phase directional audio used herein.

In another example, according to one embodiment, the train signaling sound may be directed along the train track in a forward direction ahead of the train's movement. In addition, receiver systems may be placed at other locations to receive a transmission indicating the need or desire for a train signal to be transmitted. At such locations, the transmission may be directed where humans or animals may be present that should be warned about the advance of the train. For example, an intersection along a roadway, pathway, sidewalk or the like that intersects with the train track may be provided with one or more directional audio transmitters and an associated receiver to receive an indication as to when to broadcast the directional audio train signal alarm. Upon receipt of a signal (e.g., from the train or from a detection mechanism detecting the train, such as existing systems for triggering train alarms, for example) indicating a desire for an alarm, the directional audio systems may broadcast an alarm in the area directed. For example, the directional audio may be generated along the path of the highway such that advancing cars will hear the alarm prior to reaching the intersection with the train track. If sidewalks or other areas where humans may be present relative to the train tracks exist, a directional audio transmitter may be placed to direct audio to those locations as well. Depending on the size of the area desired to broadcast the train signal, a plurality of such devices may be provided. Given the manner of the directional audio system's footprint, a plurality of such devices may be provided such that the footprints overlap in the area of concern (i.e., where humans and cars may be present or humans on sidewalks for example). As a result of the use of this system, the nuisance of a train whistle or alarm being broadcast in a 360 degrees for great distances may be eliminated or reduced. For example, the transmitter systems may each be programmed to transmit an acknowledgement of receipt of the request to broadcast and acknowledgement of actually beginning to broadcast the alarm signal. The train's transmission system may then confirm receipt of an acknowledgment. If receipt of an acknowledgment is not present, the train may resort to existing alarming systems to ensure that persons approaching an intersection would be given sufficient alarm. Also, the train may utilize a more extensive directional audio output system, such as one that generates output in all directions from the train or one that outputs audio in directions and at a distance to comply with local, state, federal or other laws, rules, regulations or ordinances. By using a system as described herein, the train companies may reduce the amount of noise pollution and nuisance to the communities that neighbor the train tracks. As a result of this cost savings, the use of the present invention may provide many economic advantages to the train systems and the train system operators.

In addition, the use of this system allows the customization of the content of the signal. Rather than providing a single broadcast whistle from the train, the directional audio units may be programmed to transmit a signal with greater level of information. For example, the signal may vary depending upon the proximity of the train to the intersection, the type of train, or the use of words to describe what is happening. For example, in many instances, humans may take a few minutes to determine that the sound they are hearing is from a train and not from an ambulance or some other alarm system. By using words such as "train arriving" or "train approaching intersection," the user will immediately understand that the reason for the alarm is due to a train and not other potential situations. Further, whereas one embodiment uses a signal transmitted from a system on the train, the signal may be transmitted based on a schedule, a mechanical detection of a train along the track, a sensor of a train or some other system that detects the train's approach.

According to one embodiment of the present invention, FIG. 1 depicts a train signaling system comprising one or more train signal transmitters 10. Train signal transmitters 10 may comprise directional audio transmitters for example. Such train signal transmitters 10 may be located adjacent to traditional signaling and barricade device 12 as a part of barricade 12 such as depicted in element 10A, or in other desired locations. Train signal transmitter 10 may be positioned near the intersection of a road 18 to signal to humans the approach of a train 14 along train track 16. Train 14 may be provided with one or more train processing systems 20. Train processing system 20 may comprise a transmitter and receiver. For example, train processing system 20 may comprise an alarm transmitter to transmit a signal to train signal transmitters 10 to indicate that train signal transmitters 10 should begin transmission of an alarm signal. In addition, train processing system 20 may comprise a receiver to receive an acknowledgement from one or more train signal transmitter 10. To transmit an acknowledgement and to receive signals, train signaling transmitter 10 may be operably connected to a train signal communications system 22 which may be configured to receive transmissions from train processing system 20 and transmit acknowledgements to train processing system 20.

It should be appreciated that communications between train processing system 20 and train signaling communications system 22 may be provided via any method desired, including, but not limited to, various forms of wireless communication such as RF communication, and the like. The transmission range of such systems would be at least as far as to enable the signal to be transmitted along train tracks and down highways and sidewalks with sufficient time in advance of the approach of the train to the intersection to warn humans of the train's pending approach. Moreover, it should be appreciated that train signal transmitter 10 may be signaled to begin transmission through a plurality of different mechanisms. For example, electromechanical switches may be used to detect a train or other event. Other detectors may also be used. Moreover, train processing system 20 may be provided along the train tracks or at other locations. Also, train processing system 20 may continuously, periodically with a short periodicity, or frequently, for example, transmit a signal. When the signal from train processing system 20 is in range of train signal transmitter 10, then train signal transmitter 10 may being transmission of one or more directional audio signals.

As shown in FIG. 1, train signal transmitter 10 may be provided at a one or more locations and directed along one or more paths and at specific locations to cover the areas where a signal is needed or desired. This provides the advantage of providing a train signal alarm only in locations desired or needed to avoid the nuisance of widespread train signal.

Figure 2:
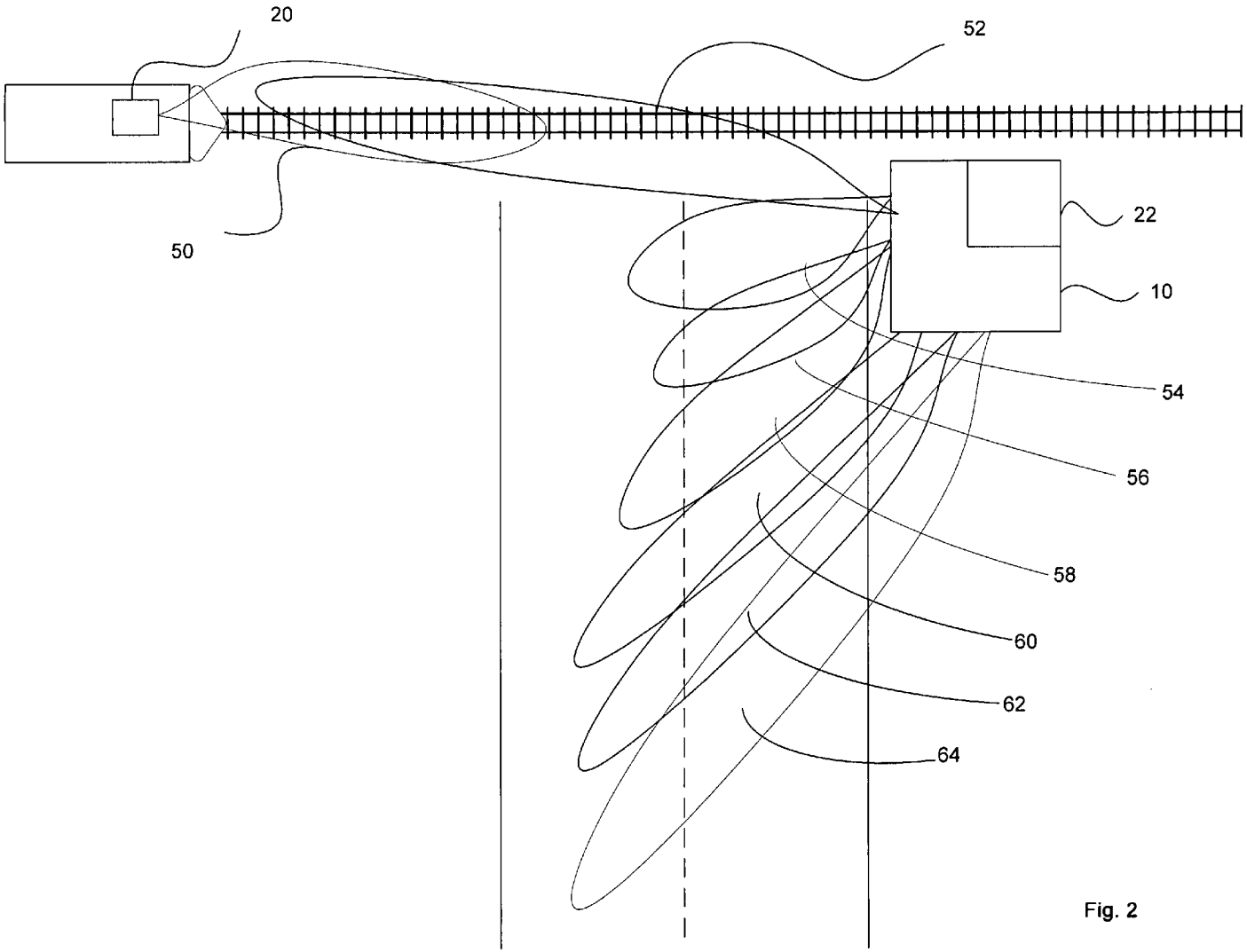
FIG. 2 depicts a schematic diagram illustrating an exemplary directional audio footprint of a plurality of directional audio transmitters used for train signaling according to an embodiment of the present invention.

While many different configurations are certainly within the scope of the present invention, FIG. 2 depicts one embodiment of a directional audio transmission system 10 comprising six different transmitters directed at different portions along a roadway. One or more of the footprints from the transmitter systems may be designed to cast its transmission of audio on a particular portion of the roadway. In addition, one of the directional audio transmitters may be provided as part of train signal transmitter 10 to transmit a directional audio signal down the train track in advance of the train to warn any humans or animals of the pending approach of the train. As described above with respect to the train signaling transmitter 10, the signaling transmitter on train processing system 20 may comprise one or more transmitters as well, each directed at a different area in advance of the train or to the sides of the track as the train approaches. The various footprints in this illustrative example are depicted as footprints 50, 52, 54, 56, 58, 60, 62, and 64. It should be appreciated that different sizes, widths, and arrangements of these footprints of the directional audio system may be provided to enable coverage of different locations as desired.

Obviously, not all roads approaching an intersection of a railroad will be straight. Therefore, the directional audio arrangement of footprints may be configured such that the footprints cast at a sufficient distance down the road regardless of its path to warn people of the approach of the train.

Figure 3:
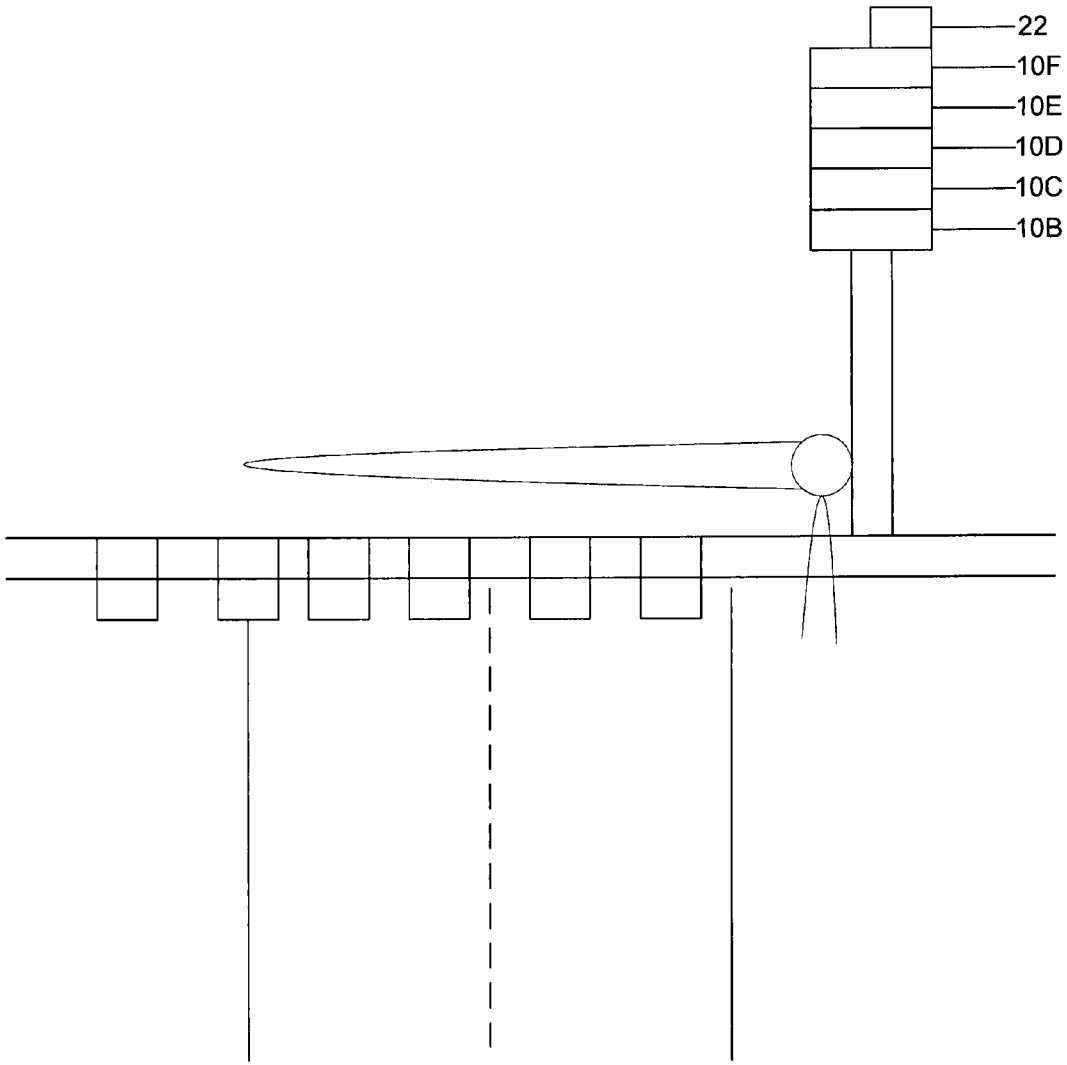
FIG. 3 depicts a side view of a directional audio tower comprising a plurality of directional audio transmitters according to an embodiment of the present invention.

FIG. 3 depicts one illustrative embodiment of a train signaling system 10 providing a plurality of transmitters 10B, 10C, 10D, 10E and 10F. The communications system 22 may be disposed on top of such transmitters or, as will be appreciated by one of ordinary skill in the art, at any other location desired. In addition, the arrangement of a plurality of transmitters on a tower may differ depending upon the footprint desired. For example, instead of being stacked on top of one another, the various transmitters may be arranged horizontally, in a square, or in any other clumped or separated configuration desired to generate the transmission footprint desired.

Figure 4:
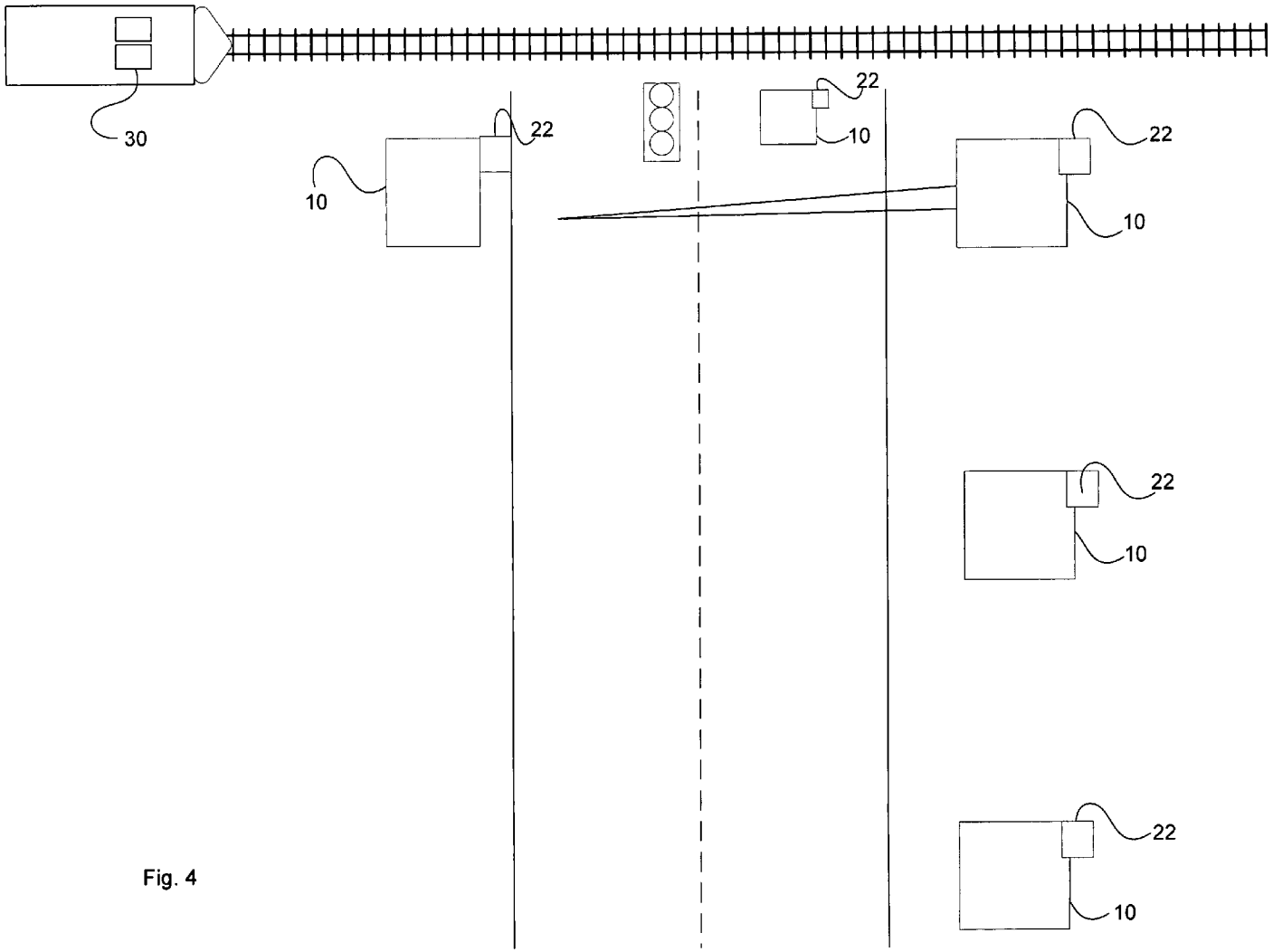
FIG. 4 depicts another embodiment of a directional audio train signaling system according to an embodiment of the present invention.

FIG. 4 depicts another illustrative example of arrangements of train signaling transmission system 10. As will be appreciated, for different types of roadways, it may be desirable to provide one or more directional audio transmitters 10 along a roadway. For example, if the road approaching an intersection with a train track 16 comprises an interstate with a high rate of speed permitted, and it may be desirable to provide warning of the train's pending approach a greater distance away from the intersection. To accomplish that task, it may be desirable to position a plurality (e.g., here three are shown whereas other numbers may also be used) of train signaling transmitter systems 10 and associated train signal communications systems 22.

FIG. 4 also depicts an embodiment in which the train processing system 20 and transmitter 30 comprise different and separate systems. While such systems may be integrated, it is also possible for them to be separate.

Figure 5:
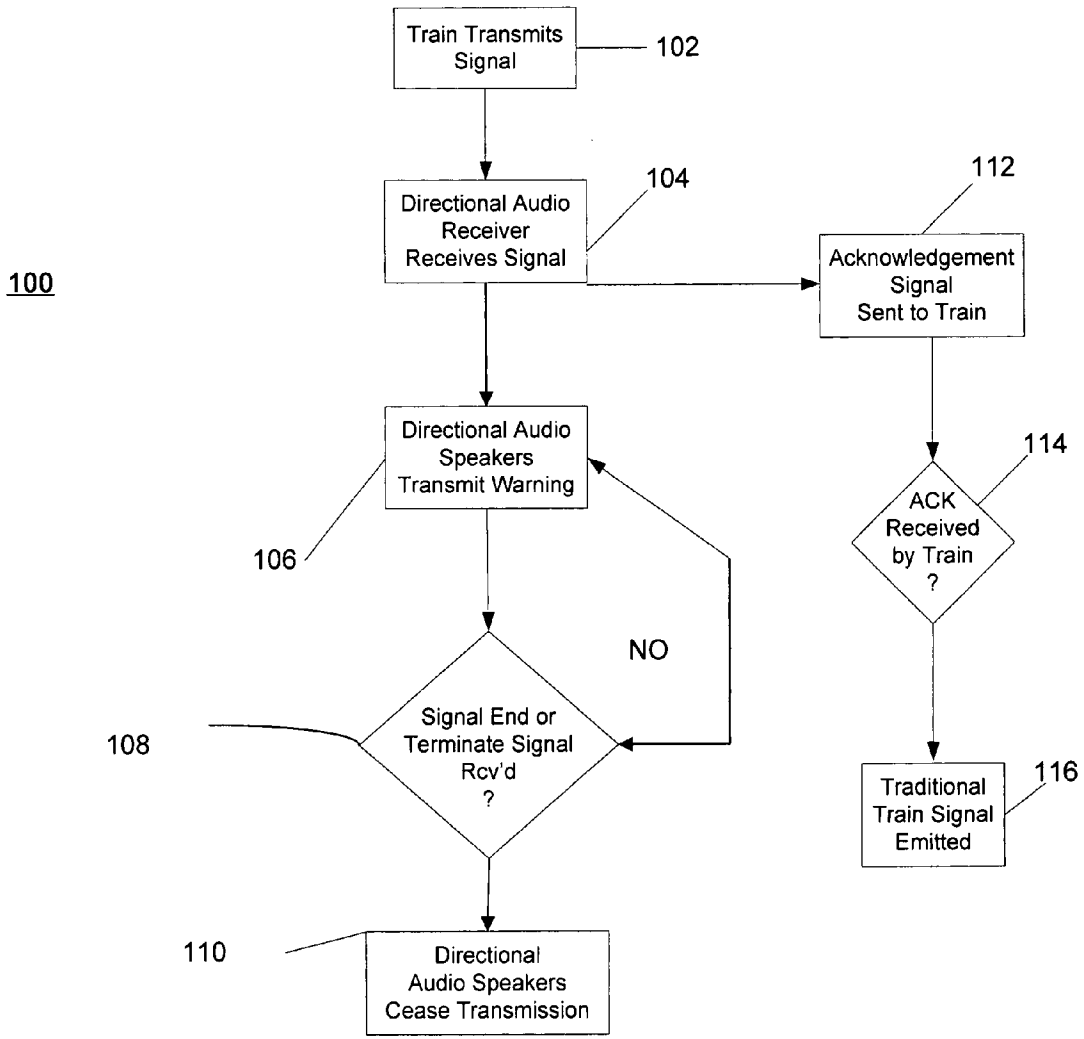
FIG. 5 depicts a flow diagram for operation of a directional audio train signaling methodology according to an embodiment of the present invention.

FIG. 5 depicts one embodiment of a method of operation of a directional audio train signaling system according to various embodiments of the present invention. As depicted, a method 100 as provided comprising one or more acts. In act 102, the train may transmit a signal. This may be provided by train processing system 20 via wireless communication as described above. In act 104, one or more directional audio communication systems (e.g., receivers) receives the signal. This may be the signal transmitted by train communications system 20 and received as part of train signal communications system 22. In act 106, the directional audio transmitters (e.g., speakers) transmit a warning signal. As discussed above, the warning may be of a variety of types including a bell, words, or any other type of warning.

In act 112, an acknowledgment signal may be transmitted from one or more of the train signal transmitter systems to the train. This may be via train signal communication system 22 to train processing system 20, for example. If an acknowledgement is received as determined in act 114, no additional acts may be taken by train processing system 20. If, however, an acknowledgement is not received within a predetermined period of time, train processing system 20 may trigger a traditional alarm via the train to ensure that pedestrians and others within the approach area of the train are sufficiently warned. In act 108, the train signal transmitter 10 may check to determine whether a termination signal has been received or that the transmit signal has stopped being received. It should be appreciated to those of ordinary skill in the art that either methodologies are within the scope of the invention, as well as any other methodologies for determining when to end a transmission at train signal transmitter 10. If the predetermined criteria for terminating the transmission is received in act 108, then in act 110 the train signal transmitter 10 (e.g., directional audio system) may cease transmission of the signal. It should be appreciated while these acts are depicted in a particular order, the order may be altered within the scope of the present invention.

In addition, whereas an embodiment depicted herein illustrates a communication system for communicating from the train to one or more directional audio transmission systems may be provided, it also is within the scope of the present invention to utilize existing transmission and indication methods for determining when to transmit a warning signal from a directional audio transmission system. For example, some train systems utilize sensors at various locations along the tracks to indicate the approach of a train. Such sensors may be connected to the system of the present invention to indicate when to transmit a directional audio warning system from station 10 along the roadway or along a sidewalk or train track. Also, existing train systems utilize various techniques for causing the barricades 12 to come down and for lights and other audible warnings to be actuated. Such signals may then be tied in to a directional audio system to direct transmission of a signal to oncoming cars and pedestrians to an intersection in question.

Further, although the embodiments of the present inventions have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein

The invention claimed is:

1. A directional audio train signaling system comprising:

a receiver that received a signal relating to a train; and one or more directional audio transmitter systems for transmitting a signal related to a train, wherein the directional audio transmitter system transmits an audible sound signal for alarming people, the audible sound signal being embedded on a focused beam of a signal carrier, where the wavelength of the signal carrier is beyond human hearing range, and wherein the signal carrier comprise an ultrasonic signal.

2. The system of claim 1 further comprising a plurality of directional audio transmitters with a transmission footprint that covers a portion of a roadway or other area of interest approaching an intersection with a train track on which the train is approaching.

3. The system of claim 1 wherein the signal is received by the receiver via wireless communications.

4. The system of claim 1 wherein the transmitter is located approximate to the intersection of a roadway and a train track.

5. The system of claim 1 further comprising a signal transmitter operably connected to the receiver for transmitting an acknowledgement upon receipt of the signal indicating the approach of a train.

6. The system of claim 1 further comprising a plurality of transmitter speakers positioned adjacent to one another broadcasting the directional audio at a plurality of overlapping areas of interest.

7. A method for signaling a message related to a train comprising:

receiving a signal relating to a train;

transmitting one or more directional audio signals in an area near a train or train track, wherein the directional audio transmitter system transmits an audible sound signal for alarming people, the audible sound signal being embedded on a focused beam of a signal carrier, and wherein the signal carrier wavelength is beyond human hearing range, and wherein the signal carrier comprise an ultrasonic signal.

8. The method of claim 7 further comprising:

transmitting a plurality of directional audio signals to cover a portion of a roadway or other area of interest near a train track.

9. The method of claim 7 wherein the signal is received via a wireless communication.

10. The method of claim 7 wherein the signal is received from a detector along the train track.

11. The method of claim 7 wherein the transmission signal is transmitted from near the intersection of a train track and a roadway.

12. The method of claim 7 further comprising transmitting an acknowledgement signal.

13. The method of claim 12 wherein the acknowledgement is sent after transmission of the directional audio signal has initiated.

14. A system for signaling information related to a train comprising:

a signal indicator indicating a time to transmit a signal related to a train; and one or more directional audio transmitter systems for transmitting a signal relating to a train, wherein the directional audio transmitter system transmits an audible sound signal for alarming people, the audible sound signal being embedded on a focused beam of a signal carrier, and wherein the signal carrier wavelength is beyond human hearing range, and wherein the signal carrier comprise an ultrasonic signal.

15. The system of claim 14 further comprising a plurality of directional audio transmitters with a transmission footprint that covers a portion of a roadway approaching an intersection with a train track on which the train is approaching or other area of interest.

16. The system of claim 14 wherein the signal is received by the receiver via wireless communications.

17. The system of claim 14 wherein the transmitter is located approximate to the intersection of a roadway and a train track.

18. The system of claim 14 further comprising a signal transmitter operably connected to the receiver for transmitting an acknowledgement upon receipt of the signal indicating the approach of a train.

19. The system of claim 14 further comprising a plurality of transmitter speakers positioned adjacent to one another broadcasting the directional audio at a plurality of overlapping areas of interest.

* * * * *